United States Patent [19]

Phillips

[11] Patent Number: 4,625,742

[45] Date of Patent: Dec. 2, 1986

[54] MULTI-FUNCTION LIGHTED WALKING CANE

[76] Inventor: Jerry G. Phillips, 4271 NW. 5th St., Apt. 47, Plantation, Fla. 33317

[21] Appl. No.: 730,725

[22] Filed: May 6, 1985

Related U.S. Application Data

[63] Continuation-in-part of Ser. No. 453,128, Dec. 27, 1983, abandoned.

[51] Int. Cl.[4] ..... A45B 3/04

[52] U.S. Cl. ..... 135/66; 135/DIG. 10; 362/102

[58] Field of Search ..... 135/DIG. 10, DIG. 11, 135/66; 362/102; 250/215

[56] References Cited

U.S. PATENT DOCUMENTS

| | | | |
|---|---|---|---|
| 3,313,929 | 4/1967 | Schiavone | 135/DIG. 10 |
| 3,546,467 | 12/1970 | Benjamin, Jr. et al. | 250/215 |
| 4,236,544 | 12/1980 | Osaka | 135/66 |
| 4,345,305 | 8/1982 | Kolm et al. | 362/102 X |
| 4,527,824 | 7/1985 | Rosenfeld | 135/66 X |

FOREIGN PATENT DOCUMENTS

| | | | |
|---|---|---|---|
| 860630 | 9/1940 | France | 135/45 R |
| 1027932 | 2/1953 | France | 362/102 |
| 1270457 | 4/1972 | United Kingdom | 135/DIG. 10 |
| 2110081 | 6/1983 | United Kingdom | 135/DIG. 10 |

*Primary Examiner*—Robert A. Hafer
*Assistant Examiner*—Arnold W. Kramer
*Attorney, Agent, or Firm*—Oltman and Flynn

[57] ABSTRACT

A multi-function lighted walking cane which may be used in the dark as a cane for lighting the user's walkway and may also be used as a beacon to show the user's position to others. The light-emitting portion of this invention is housed adjacent and within a translucent or transparent lens positioned near the lower end of the cane. It may optionally have a raised lens shape which enhances the light-dispersing characteristics of the cane. The lens is positioned so that light is cast forward of the user along the ground. A plurality of small apertures may also be provided in the hollow cane adjacent the light source around the remaining surface juxtaposed to the lens to provide the beacon light function. This lower portion of the cane, housing the light source near its lower end, contains the battery and the power supply. The length of the cane may is made adjustable. The cane has a connector for attaching a battery charger to recharge batteries in the cane.

9 Claims, 8 Drawing Figures

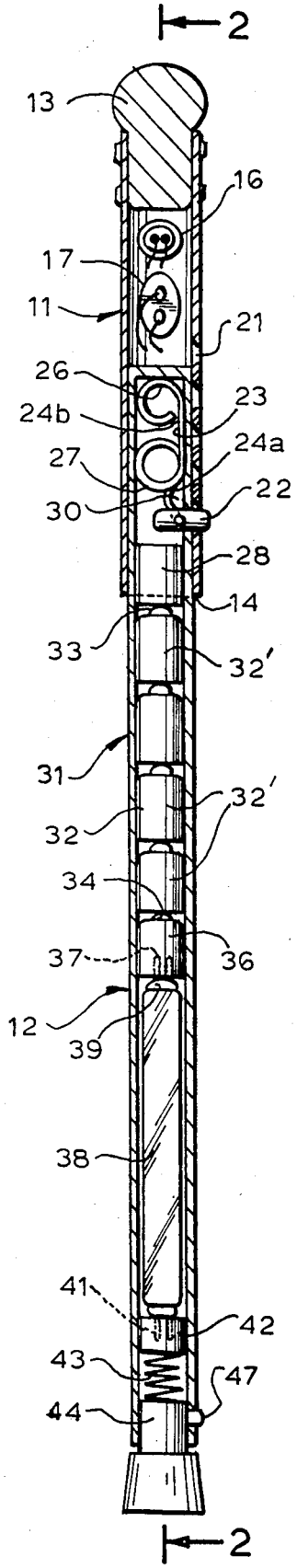
FIG. 1
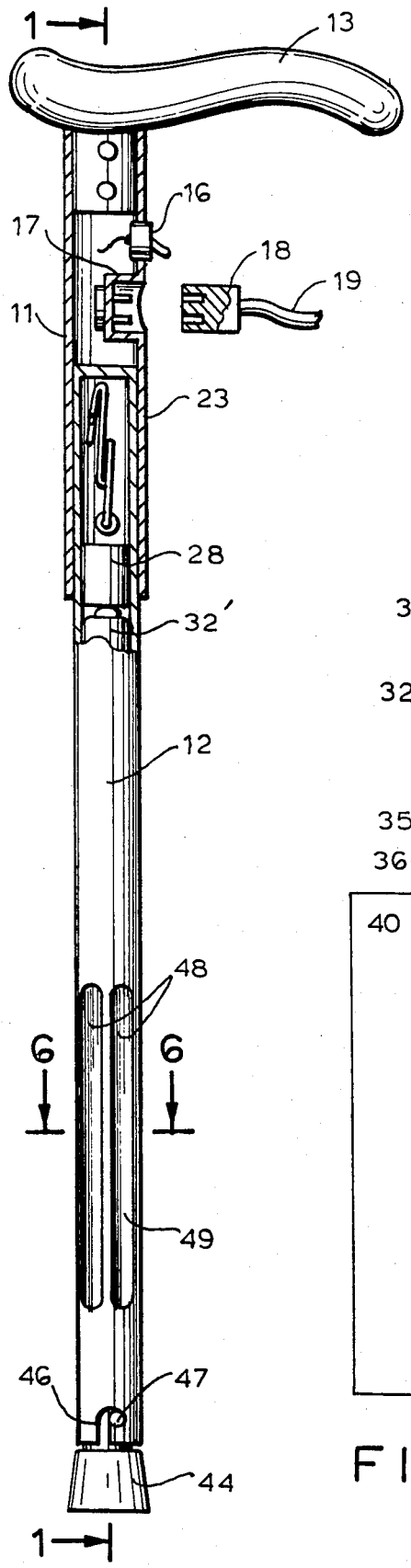
FIG. 2
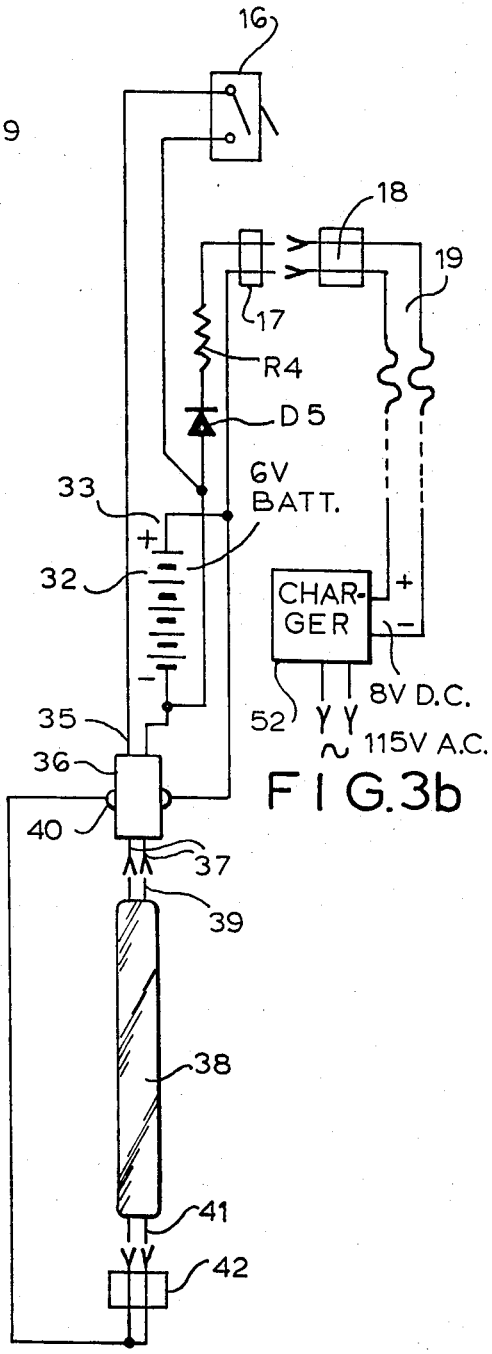
FIG. 3b
FIG. 3a

FIG. 4
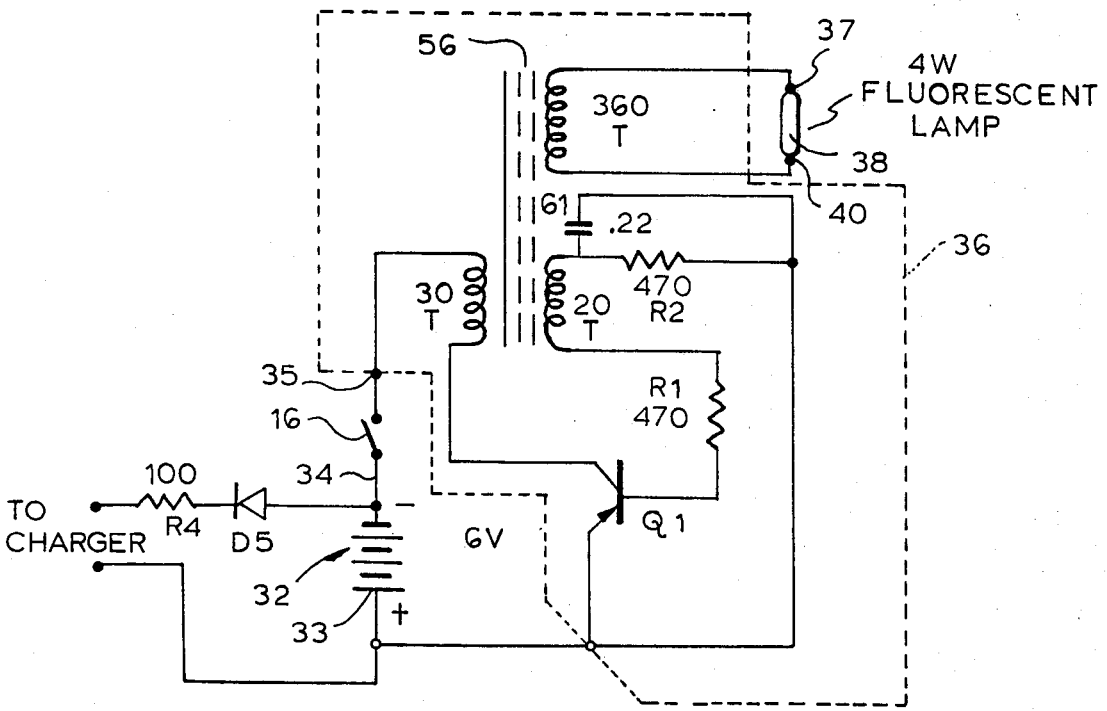
FIG. 5
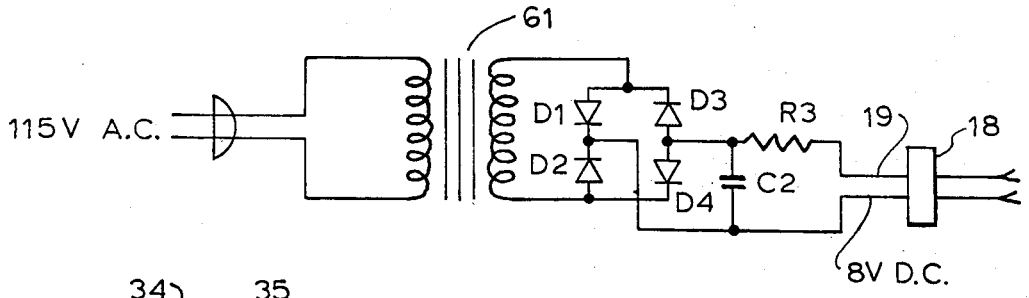
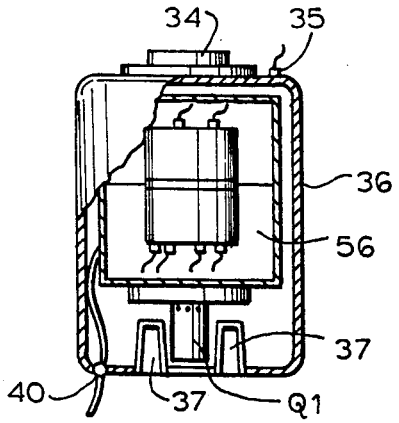
FIG. 7
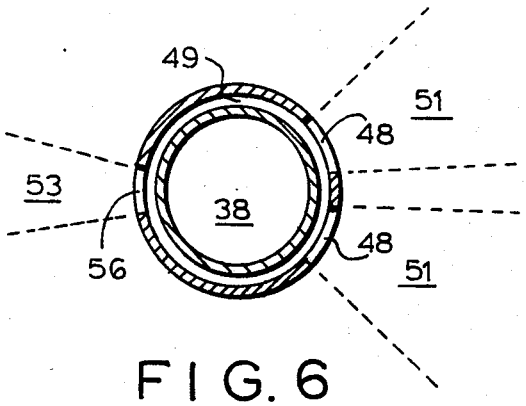
FIG. 6

MULTI-FUNCTION LIGHTED WALKING CANE

This is a continuation-in-part application of Ser. No. 06/453,128, filed 12-27-83 now abandoned.

BACKGROUND OF THE INVENTION

This invention relates generally to illuminated walking canes and more particularly to a multi-function walking cane for lighting a user's way in the dark.

Prior art discloses many devices which incorporate illuminating means into umbrellas, batons, bicycle safety poles, signal lights, or the like. However, none of these devices may be used as a cane, with or without a light or visible signal beacon.

Another group of prior inventions, such as U.S. Patents:

U.S. Pat. No. 2,173,624
U.S. Pat. No. 2,435,650
U.S. Pat. No. 2,642,519
U.S. Pat. No. 4,064,429
U.S. Pat. No. 4,236,544 generally teach walking canes which include beacon means for being seen by e.g. motorists. These devices, varying primarily in specific structure, are intended not to light the user's way, but merely as a beacon to warn others of the user's presence in the dark.

Still another group of prior art inventions teaches multi-function canes or walking sticks. U.S. Pat. No. 2,723,780 discloses an illuminated umbrella and walking stick which includes a unique light-energizing means, that being a spring switch at the lower ground-contacting end of that walking stick. Whenever the user presses the lower end of the stick against the ground, the light will shine. A portion of this stick is removable from both ground pressure switch and hand knob to provide a separate flashlight or torch. In U.S. Pat. No. 4,013,881 is disclosed a combination user light source signal cane and lighted beacon at the lower end. However, a complex structure reflects light sideways from a beacon while allowing a portion of the light to escape longitudinally from the lower end of the cane for lighting objects.

A third group of walking canes or sticks discloses specific structures for providing light for use in the dark by the user. U.S. Pat. No. 2,271,190 to Giaimo teaches a cane having a forwardly-facing light source near the lower end of the cane for casting a light beam across the ground forward of the user. The switch is positioned low for foot access. Barnes et al, in U.S. Pat. No. 3,336,469 discloses a lighted walking cane which includes a downwardly-aimed light bulb housing opening positioned high along the cane just down from the curved handle. A switch just above controls bulb illumination out of the housing aperture forward and down from the user casting a beam onto the ground to light the user's way. And in U.S. Pat. No. 1,659,346, Beatty teaches a light for canes or umbrellas which disperses light sideways out of a plurality of apertures near the distal end of the shaft. In umbrella form, this light is cast over the top of the opened umbrella. In cane form, the light is cast horizontally and 360 degrees about the longitudinal axis of the cane across the ground. The switch is adjacent the handle. Generally, these canes emit less than a desirable amount of light to illuminate the user's way.

The present invention discloses a multi-function walking cane which may cast light forward of the user and may also serve as a beacon signal. In the preferred embodiment, the light source is an elongated longitudinal fluorescent tube. The light source includes a lens, having a raised bulbous-like cross-sectional shape for improved increased light dispersion. The lower part of the cane may be detached to function independently as an elongated light stick. Battery power (D.C.) is housed in the lower cane part.

SUMMARY OF THE INVENTION

A multi-function lighted walking cane which may be used in the dark as a cane for lighting the user's walkway and may also be used as a beacon to show the user's position in relation to others. The lower part of the cane, which contains a fluorescent tube, is telescopingly receivable in an upper tubular part. The light-emitting portion of this invention is housed adjacent and within a raised translucent or transparent lens positioned near the lower end of the cane. This raised lens shape enhances light-dispersing characteristics of the cane. The lens may be positioned so that most of the light is cast forward of the user along the ground. A plurality of small apertures may also be provided in the hollow cane adjacent the light source around the remaining surface juxtaposed to the lens to provide the beacon light function. The lower part of the cane houses the light source near its lower end, batteries for power supply and a converter for converting the low battery voltage to high AC-voltage required for the fluorescent tube.

The converter is specially constructed to fit in the narrow space available inside the tubular cane. The length of the cane is advantageously made adjustable.

The batteries used for power supply may be conventional dry cells stacked axially in series connection inside the hollow tubular lower part. In an especially advantageous embodiment the batteries may be rechargeable batteries and the cane may have a connector for connecting it to an external battery charger.

It is therefore an object of this invention to provide a multi-function lighted walking cane having a fluorescent tube for improved light-emitting characteristics.

It is another object of this invention to provide the above lighted cane having rechargeable batteries connected to a charging connector.

It is yet another object of the invention to provide a lighted walking cane having improved light-emitting characteristics achieved partially by the fluorescent tube, and a suitably shaped lens.

And it is another object of this invention to provide a multi-function lighted walking cane which may also function as a light beacon to identify the user's location in the dark.

Further objects and advantages of this invention will be apparent from the following detailed description of presently preferred embodiments which are illustrated schematically in the accompanying drawings.

BRIEF DESCRIPTION OF THE DRAWINGS

FIG. 1 is a cross-sectional side-elevation view of the light cane, showing its interior construction;

FIG. 2 is a part cross-sectional front elevation view of the light cane seen along the line 2—2 of FIG. 1;

FIGS. 3*a* and *b* are a schematic circuit diagram of the light cane;

FIG. 4 is a schematic circuit diagram of the voltage converter;

FIG. 5 is a schematic diagram of the battery charger;

FIG. 6 is a transverse cross-sectional view through the lower part of an embodiment of the invention, showing a lens radiating light in two forward facing beams; and FIG. 7 shows details of the interior construction of the voltage converter.

DESCRIPTION OF THE PREFERRED EMBODIMENTS

FIGS. 1 and 2 show the lighted walking cane in vertical cross-sectional views. An upper tubular part 11 has a handle 13 rigidly attached to its upper end, and its lower end 14 is adapted for telescopingly receiving a lower-tubular part 12 which fits slidably inside the upper tubular part 11. An on-off switch 16 is positioned under the handle so that a user can conveniently turn the cane on or off with a single finger as needed. Below the on/off switch 16 there is a two-wire connector 17 for receiving a mating connector 18 of a charge cord 19 connected to a battery charger described in more detail hereinbelow.

The wiring to the on-off switch 16 and the charger connector is only indicated, but not shown in full, in order not to obscure the details of the lighted cane. The upper tubular part 11 has a series of axially spaced-part holes 21 which serve to receive a radially outward-projecting spring-biased locking button 22 attached to one leg **24*a* of a spring 23 having two legs 24*a* and 24*b* connected by a loop 27, of which the other leg 24*b* may advantageously be formed as a loop 26, with both loops abutting the inside wall of the lower tubular part 12. The locking button 22 projects slidably through a matching hole 30 in the wall of the lower part 12 and through one of the holes 21 of the upper part. The button 22 can be depressed radially inward against the spring 23 to allow the upper part to slide up or down for selecting an appropriate suitable length of the cane. In the selected position, the locking button 22 is again allowed to project out through one of the holes 21**.

The lower tubular part 12 is enclosed near the upper end by a removably attached plug 28, which defines the upper boundary of a tubular elongate battery compartment 31 for holding a suitable number of series connected batteries 32, stacked axially end-to-end with the upper battery 32' abutting upward with its upper terminal against a contact 33 attached to the lower surface of the plug 28, while the bottom battery 32" is abutting with its lower terminal against a converter contact 34 at the upper end of the cylindrical voltage converter 36. The lower end of the voltage converter 36 makes contact at two converter terminals 37 with the upper terminals 39 of a fluorescent tube 38 which fits snugly inside the lower end of the tubular space formed by the walls of the lower tubular part 12.

The fluorescent tube is a 4-watt type manufactured among others by Aurora electric Co. Ltd. in Seoul, Korea, which is uniquely suitable for use as a light source for a lighted cane, due to its small diameter.

The fluorescent tube 38 engages with its upper terminals 39 the mating downward facing terminals 37 of the converter 36, and with its lower terminals 41 the mating contact piece 42 which is spring-biased upward by a helical spring 43, which abuts downward against a rubber endplug 44, which is removably received into the lower end of the lower tubular part 12, and secured by a bayonet type locking arrangement consisting of a curved slot 46 in the tubular part 12 and a locking part 47 or other suitable holding means.

Alternatively, the endplug 44 may be be threadedly screwed into the bottom end of the tubular part 12.

A plurality, e.g. two, of lateral, elongate axially oriented windows 48 are cut into the wall of the tubular part 12 through which light from the tube 38 can radiate as shown in FIGS. 2 and 6.

In another embodiment a cylindrical elongate lens 49 is disposed surrounding the fluorescent tube 38, as shown in more detail in the cross-sectional view of FIG. 6, which is taken along the line 6—6 of FIG. 2. The lens 49 serves to protect the fluorescent tube 38, and is made of a clear plastic material. The windows 48 project light forward as beams 51, and may have rearward facing smaller apertures 56 for projecting light rearward and optionally to the sides as narrower beams 53.

The lens material is advantageously of a clear transparent plastic of high light conductivity such as acrylic or the like.

FIG. 3*a* shows a circuit wiring diagram of the electrical circuit of the light cane. The batteries 32 produce in series connection approximately 6 volts and are connected to the two end contacts 33 and 34. The upper contact 33 is connected, to the second input terminal 37 of the converter 36, and the contact 34 serves as the first input terminal to the converter 36. One of the converter high voltage output terminals is the terminal 40 which is connected to the bottom contact piece 42, which engages in parallel the two lower terminals 41 of the fluorescent tube 38. The other converter output is the parallel connected contacts 37 which engage to two upper terminals 39 of the fluorescent tube. The two battery contacts 33 and 34 are also connected through a diode D5 and resistor R4 to the battery charge connector 17 at the upper end of the light cane.

FIG. 3*b* shows a battery charger 52 connected at one side to 115 volts AC and has an output cord 19 terminated in a plug 18 which matches the connector 17. The charger output supplies approximately 8 volt DC.

FIG. 4 shows the circuit diagram of the voltage converter which is essentially a transistor oscillator built around the small power transistor Q1, having a breakdown voltage VCE of at least 500 volts A.C. peak to peak and which is adapted to fit inside the very small constraining space available inside the tubular lower part of the light cane, and provides, on closure of the on/off switch 16, a high initial voltage of about 130 volts A.C. on the secondary winding with 360 turns, which is high enough to fire the tube 38. Once the tube is fired, the increased current in the secondary winding with 360 turns saturates the powder iron core 56 at the peak of each cycle so that an esssentially square wave output voltage of approximately 40 volts is produced, which keeps the fluorescent tube 38 lit with a high degree of efficiency. The core is a powder core type H5A 4307 which is manufactured by TDK, Inc. and others, and which is well suited in this application due to its high permeability and suitable shape. A primary winding with 30 turns provides a circuit between the transistor collector, switch 16 and the negative battery contact 34. A feedack winding with 20 turns provides feedback to the transistor base terminal to sustain oscillation, at a frequency of approximately 140 kHz.

FIG. 7 shows details of the interior construction of the voltage converter 36. Most of the interior is filled with the transformer 56 and the power transistor Q1, while the smaller components, the resistors R1 and R2 and the capacitor C1 fill the space therebetween.

FIG. 5 shows circuit details of the battery charger circuit, consisting of a transformer 61 connected at one side to the power main voltage 115 A.C. and at the other side to a fourway rectifier consisting of diodes D1–D4 providing DC current to the output connector 18 through filter components R3, C2.

I claim:

1. A lighted walking cane which comprises:

an upper tubular part having a handle at its upper end and an open ended lower end;

a lower tubular part telescopingly received in said upper part;

a battery compartment in said lower part for containing a plurality of axially disposed, series connected batteries in the battery compartment; having an upper and a lower battery terminal for producing a battery voltage;

a voltage converter in said lower part having input terminals for receiving and converting the battery voltage to a high secondary A.C. voltage;

a fluorescent tube disposed axially in the lower end of said lower tubular part having end terminals connected to said high A.C. voltage for firing and maintaining said fluorescent tube in lighted condition, said lower tubular part having apertures in its wall for admitting light to the outside;

electrical circuit means for interconnecting said battery compartment, said converter and said fluorescent tube; and locking means for adjustably locking together said upper and lower tubular parts.

2. Lighted walking cane according to claim 1 wherein said electrical circuit means further comprises:

an on/off switch disposed proximal to said handle for completing and deactivating said electrical circuit means for respectively turning said fluorescent tube on and off.

3. Lighted walking cane according to claim 1 wherein said locking means further comprise:

a plurality of axially spaced apart adjustment holes in the wall of the upper tubular part;

a matching hole in the wall of the lower tubular part matchingly alignable with any one of said adjustment holes;

a radially outward projecting locking button slidably receivable in said matching hole and in any of said adjustment holes for locking rigidly together said upper and lower tubular part.

4. Lighted walking cane according to claim 1 wherein said voltage converter comprises:

a transistor oscillator;

a transformer being part of said oscillator, said transformer comprising a core of iron powder having high permeability.

5. Lighted walking cane according to claim 1 wherein said apertures further comprise a plurality of elongate axially oriented forward facing windows in said lower tubular part for admitting light beams from said fluorescent tube.

6. Lighted walking cane according to claim 5 further comprising rearward facing holes in said lower tubular part for admitting light beams from said fluorescent tube.

7. Lighted walking cane according to claim 6 further comprising a cylindrical translucent lens interposed between the wall of said lower tubular part and said fluorescent tube.

8. Lighted cane according to claim 1 further comprising a two wire connector in said cane for receiving an external plug-ended charger cord for applying charge current to said batteries.

9. Lighted cane according to claim 8 wherein said two wires of said connector are connected to said upper and lower battery terminals, respectively.

* * * * *